US006837145B1

(12) United States Patent
McBride et al.

(10) Patent No.: US 6,837,145 B1
(45) Date of Patent: Jan. 4, 2005

(54) FLUID POWERED ACTUATOR

(75) Inventors: William Earl McBride, Tulsa, OK (US); Kenneth E. Thompson, Tulsa, OK (US)

(73) Assignee: Air Power Systems Co., Inc., Tulsa, OK (US)

( * ) Notice: Subject to any disclaimer, the term of this patent is extended or adjusted under 35 U.S.C. 154(b) by 91 days.

(21) Appl. No.: 10/323,203

(22) Filed: Dec. 18, 2002

(51) Int. Cl.[7] ..... F15B 13/042

(52) U.S. Cl. ..... 92/131; 92/187; 92/189; 137/625.66

(58) Field of Search ..... 92/131, 187, 189; 137/625.66

(56) References Cited

U.S. PATENT DOCUMENTS

| | | | | |
|---|---|---|---|---|
| 2,818,314 A | | 12/1957 | Nicholas | 309/20 |
| 3,003,428 A | | 10/1961 | Christenson | 103/175 |
| 3,160,174 A | * | 12/1964 | Schmiel et al. | 91/178 |
| 4,033,233 A | | 7/1977 | Toi | 91/374 |
| 4,354,527 A | * | 10/1982 | McMillan | 91/464 |
| 4,355,660 A | * | 10/1982 | Huffman | 137/625.66 |
| 4,478,240 A | * | 10/1984 | Tanner | 137/625.66 |
| 4,585,024 A | * | 4/1986 | Esseniyi | 137/625.66 |
| 4,831,916 A | | 5/1989 | Leigh-Monstevens et al. | 92/129 |
| 4,884,495 A | * | 12/1989 | Groeneveld | 92/131 |
| 5,442,993 A | | 8/1995 | Baliotti, II et al. | 92/84 |
| 5,836,235 A | | 11/1998 | Rudiger et al. | 92/178 |
| 5,947,249 A | | 9/1999 | Tobiasz | 192/85 |
| 6,199,822 B1 | | 3/2001 | Hakansson | 251/58 |
| 6,415,706 B1 | | 7/2002 | Poschl et al. | 92/169 |
| 6,425,316 B1 | | 7/2002 | Phan | 92/187 |
| 6,467,393 B2 | | 10/2002 | Ploog | 92/131 |
| 6,470,791 B1 | | 10/2002 | Welter et al. | 92/188 |

FOREIGN PATENT DOCUMENTS

GB 2235961 A 3/1991

* cited by examiner

*Primary Examiner*—Edward K. Look
*Assistant Examiner*—Igor Kershteyn
(74) *Attorney, Agent, or Firm*—Head, Johnson & Kachigian

(57) ABSTRACT

A three position fluid powered actuator having a piston reciprocally positioned within a cylindrical chamber in a body. The piston has a socket in communication with an axial opening through the piston. A piston shaft has a first end passing through the axial opening and into the socket and has a second end passing through a spring chamber in the body. A compression spring surrounds the piston shaft in the spring chamber. A pair of fluid passageways extend into the cylindrical chamber, whereby fluid pressure in a first passageway will move the piston in a first direction and fluid pressure in a second passageway will move the piston in a second direction.

14 Claims, 2 Drawing Sheets

FLUID POWERED ACTUATOR

BACKGROUND OF THE INVENTION

1. Field of the Invention

The present invention is directed to a fluid powered actuator having a piston reciprocally positioned to move to three different positions. In particular, the present invention is directed to a fluid powered actuator having three positions which will accommodate out of axial shaft movement.

2. Prior Art

Various types of fluid actuators are utilized for moving various types of machinery from one position to another position. These actuators utilize fluid to force a piston within a bore to move a shaft and may be either hydraulic or pneumatic. In one type of actuator, fluid pressure is directed to either side of the piston within a fluid tight cylinder to move the piston between positions. Three position actuators have been known, such as Assignee's own actuator shown in U.S. Pat. No. 3,991,661.

Oftentimes these actuators are attached to the end of a hydraulic valve spool in order to raise or lower equipment such as a dump bed of a trailer or to extend or retrack a hydraulic cylinder on various types of equipment. When the fluid powered actuator is added to equipment, the shaft length of the actuator and the spool itself is extended. In the event that the piston shaft movement is even slightly out of axial in its movement, it will tend to bind and interfere with operation of the piston.

Accordingly, it is desirable to accommodate a fluid powered actuator having provision for accommodating out of axial shaft movement.

It is a further object and purpose of the present invention to provide a three position fluid powered actuator that will compensate for out of axial shaft movement.

It is a further object and purpose of the present invention to provide a fluid actuator that is adapted to move to multitude of selected positions.

It is a further object and purpose of the present invention to provide a fluid actuator comprised of readily available components that is simple to assemble and install.

SUMMARY OF THE INVENTION

The present invention provides a fluid powered actuator that will accommodate out of axial shaft movement. The fluid actuator includes a piston which is reciprocally positioned within a cylindrical chamber of a body of the actuator. The piston has a channel formed on its external circumferential surface with an O-ring or other seal mechanism residing therein to engage the interior wall of the cylindrical chamber and form a fluid tight seal therewith.

The piston includes an open end and a socket having a recess. Opposed to the open end of the piston is an axial opening.

A piston shaft has a first end passing through the axial opening and into the open socket of the piston. The first end of the piston shaft terminates in a shoulder having a larger diameter than the piston shaft.

The piston shaft has a second end opposed to the first end which passes through a spring chamber axially aligned with the cylindrical chamber of the body. Within the spring chamber, a compressor spring surrounds the piston shaft.

One end of the compression spring engages the first flange bushing while the opposite end of the compression spring engages a second flange bushing. The piston shaft and, accordingly, the piston will be capable of being moved from a position at rest where the spring is not in compression. The force of the compression spring will urge the piston back to a center position.

The cylindrical chamber forms a fluid tight chamber that may be pressurized. Fluid to the cylindrical chamber is delivered by one of two fluid passageways, a first fluid passageway and a second fluid passageway. If the piston shaft is out of axial alignment, the operation of the piston and the actuator will not be adversely affected.

DETAILED DESCRIPTION OF THE PREFERRED EMBODIMENTS

The embodiments discussed herein are merely illustrative of specific manners in which to make and use the invention and are not to be interpreted as limiting the scope of the instant invention.

While the invention has been described with a certain degree of particularity, it is to be noted that many modifications may be made in the details of the invention's construction and the arrangement of its components without departing from the spirit and scope of this disclosure. It is understood that the invention is not limited to the embodiments set forth herein for purposes of exemplification.

Figure 1:
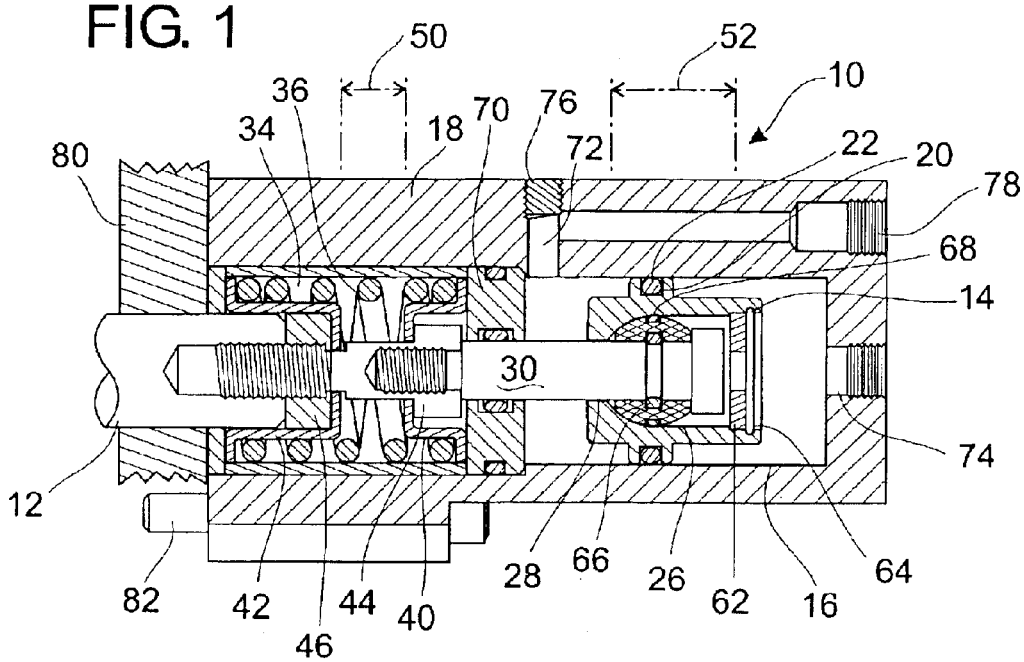
FIG. 1 illustrates a sectional view of a fluid actuator constructed in accordance with the present invention.
Figure 3:
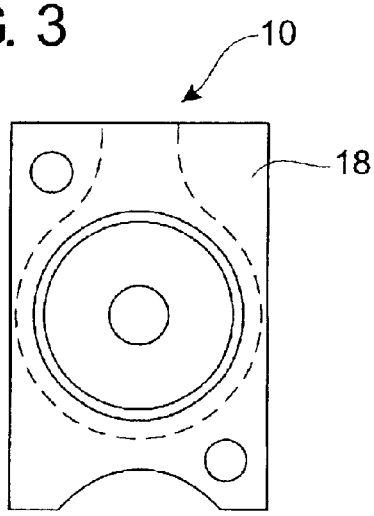
FIG. 3 illustrates a front view of a body.

Referring to the drawings in detail, FIG. 1 illustrates a sectional view of a first embodiment of an actuator 10 which is fastened to and connected to an hydraulic valve spool 12 of an hydraulic section 80 which is used to raise or lower equipment. The actuator 10 will be connected to the hydraulic section 80 by fasteners, such as fastener 82. The end of the actuator 10 which abuts the hydraulic section is shown in FIG. 3. It will be understood that the fluid actuator 10 of the present invention may be used with various types of equipment to move components of machinery between different positions.

The fluid actuator includes a piston 14 which is reciprocally positioned within a cylindrical chamber 16 of a body 18 of the actuator 10. The piston 14 has a channel 20 formed on its external circumferential surface with an O-ring 22 or other seal mechanism residing therein. The O-ring 22 engages the interior wall of the cylindrical chamber 16 to form a fluid tight seal therewith.

Figure 2:
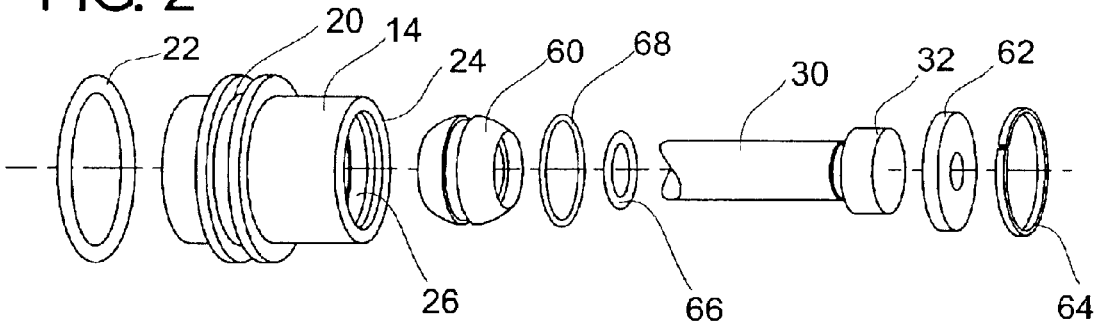
FIG. 2 illustrates an exploded view of a piston portion of the piston shaft and its accompanying components which is a part of the actuator shown in FIG. 1.

The piston 14 and its components are shown in exploded view in FIG. 2. The piston includes an open end 24 and a socket 26 having a spherical recess. Opposed to the open end 24 of the piston is an axial opening 28.

A piston shaft 30 has a first end passing through the axial opening 28 and into the open socket 26 of the piston 14. The first end of the piston shaft 30 terminates in a shoulder 32 having a larger diameter than the piston shaft 30.

The piston shaft 30 has a second end opposed to the first end which passes through a spring chamber 34 which is axially aligned with the cylindrical chamber 16 in the body 18. Within the spring chamber 34, a compression spring 36 surrounds the piston shaft 30.

One end of the compression spring 36 engages a first flange bushing 40 while the opposite end of the compression spring engages a second flange bushing 42. The first flange bushing 40 engages with and is moved by shoulder 44 on the piston shaft. Likewise, second flange bushing 42 is engaged with and is moved by stop 46 on the piston shaft.

The piston shaft 30 and, accordingly, the piston 14 will be capable of being moved from a position at rest shown in FIG. 1 where the spring is not in compression. The piston 14 and accompanying shaft will be moved either to the right or to the left depending on the movement of the piston. Arrows 50 and 52 illustrate the direction and length of this movement. In the event that the piston 14 is moved either to the left or to the right, the force of the compression spring 36 will urge the piston back to a center position shown in FIG. 1.

Returning to a consideration of the piston 14, a spherical ball 60 resides in the spherical recess in the socket 26. The ball 60 includes an axial opening which receives the piston shaft 30 therethrough. The spherical ball 60 is held in place within the socket by the shoulder 32 on the first end of the piston shaft. The shoulder and its piston shaft are retained within the socket by a circular keeper 62 and a spring retaining ring 64.

A seal mechanism is provided between the spherical ball 60 and the socket 26 and between the ball and the shaft. In the present embodiment, an O-ring 66 resides between the shaft and the axial opening in the ball and an O-ring 68 resides within a groove in the external surface of the ball which engages the socket 26. Accordingly, a fluid-tight seal is created so that pressurized fluid in the cylindrical chamber 16 will not move past the O-rings into the socket.

The cylindrical chamber forms a fluid tight chamber that may be pressurized. The cylindrical chamber 16 is separated from the spring chamber 34 by a seal ring 70 having an opening therethrough to receive the piston shaft.

Figure 4:
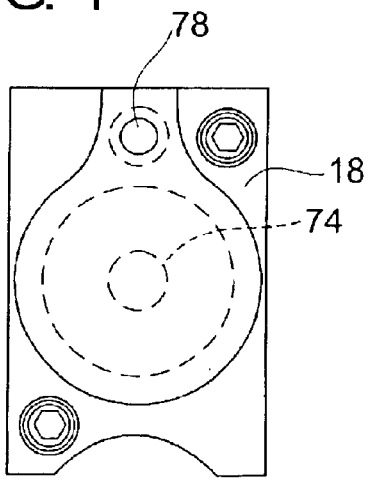
FIG. 4 illustrates a rear view of a body of the actuator shown in FIG. 1.

Fluid to the cylindrical chamber is delivered via one of two fluid passageways, a first fluid passageway 72 and a second fluid passageway 74. FIG. 4 illustrates a rear view of body 18 with fluid passageways 74 and 78 visible. Fluid passageway 78 by way of passage 72 with plug 76 closing top opening 78. Pneumatic or hydraulic fluid may be utilized within the teachings of the invention.

Figure 5:
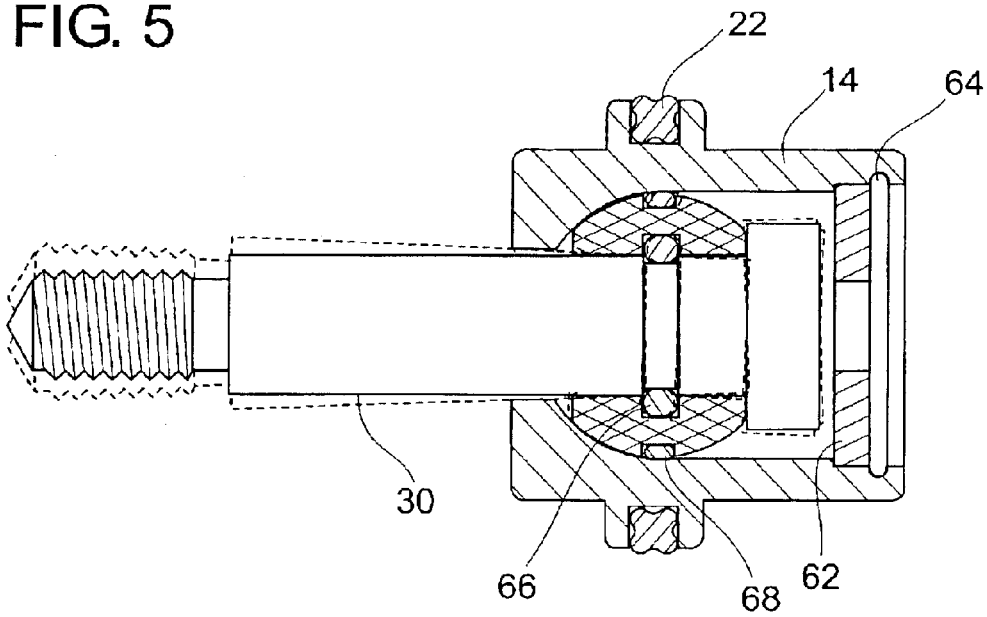
FIG. 5 illustrates a partial sectional view of the piston and piston rod illustrating the out of axial movement which will be accommodated by the present invention.

FIG. 5 illustrates the piston and piston shaft apart from the actuator. As best seen in FIG. 5, the spherical ball 60 will accommodate rotational movement with respect to the piston while maintaining a fluid tight seal. Accordingly, if the piston shaft 30 is out of axial alignment, the operation of the piston and the actuator will not be adversely affected.

Figure 6:
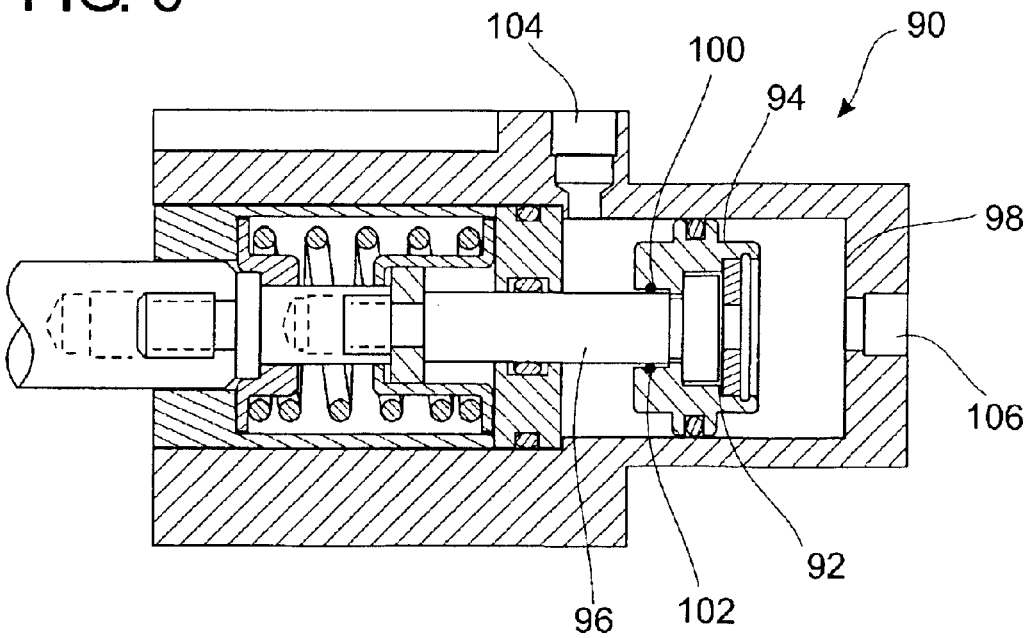
FIG. 6 illustrates a partial view of a second preferred embodiment of a fluid actuator constructed in accordance with the present invention.

FIG. 6 illustrates an alternate preferred embodiment of the fluid actuator 90 wherein a seal mechanism is created between the socket 92 of the piston 94 and the piston shaft 96 without the use of a spherical ball. An O-ring 100 resides between the external circumference of the piston shaft and an axial opening 102 of the piston 94. The piston 94 reciprocates within a cylindrical chamber 98 as described in the embodiment shown in FIGS. 1 through 4. The piston shaft 96 has a first end passing through the axial opening 102 and into the open socket 92 of the piston 94.

Fluid to the cylindrical chamber is delivered via one of two fluid passageways, a first fluid passageway 104 and a second fluid passageway 106.

The fluid actuator of the present invention is self contained and simple to assemble and install. The actuator does not have to be disassembled in order to install. Attachment of the actuator to the hydraulic valve spool may be accomplished with only a wrench, such as a hex wrench.

Whereas, the present invention has been described in relation to the drawings attached hereto, it should be understood that other and further modifications, apart from those shown or suggested herein, may be made within the spirit and scope of this invention.

What is claimed is:

1. A fluid powered actuator comprising:

a piston reciprocally positioned within a cylindrical chamber in a body, said piston having a socket in communication with an axial opening;

a piston shaft having a first end passing through said axial opening of said piston and into said socket wherein movement of said shaft first end is restrained by a keeper and having an opposed second end passing into a spring chamber in said body, said spring chamber adjacent to said cylindrical chamber;

a compression spring surrounding said piston shaft in said spring chamber; and a pair of fluid passageways to said cylindrical chamber, whereby fluid pressure in a first passageway will move said piston in a first direction and fluid pressure in a second passageway will move said piston in a second direction.

2. A fluid powered actuator as set forth in claim 1 wherein said second end of said piston shaft terminates in a coupler.

3. A fluid powered actuator as set forth in claim 1 wherein said socket is spherical and including a ball in said socket, wherein said ball includes an axial opening to receive said piston shaft therethrough.

4. A fluid powered actuator as set forth in claim 3 including a seal mechanism between said ball and said shaft.

5. A fluid powered actuator as set forth in claim 3 including a seal mechanism between said ball and said socket to create a fluid tight seal.

6. A fluid powered actuator as set forth in claim 5 wherein said seal mechanism includes an O-ring on a circumference of said ball.

7. A fluid powered actuator as set forth in claim 1 wherein said cylindrical chamber is separated from said spring chamber by a seal ring.

8. A fluid powered actuator as set forth in claim 1 wherein said piston has a cylindrical exterior having a circumferential groove therein and an O-ring within said groove to form a fluid tight seal with said cylindrical chamber.

9. A fluid powered actuator as set forth in claim 1 wherein said spring has a pair of opposed ends, each said end engaging flange bushing which retains a protrusion on said shaft.

10. A fluid powered actuator as set forth in claim 1 including fasteners to fasten said body to machinery.

11. A fluid powered actuator as set forth in claim 1 wherein said first shaft end terminates in a shoulder which engages said keeper retained in said socket of said piston.

12. A fluid powered actuator comprising:

a piston reciprocally positioned within a cylindrical chamber in a body, said piston having a spherical socket in communication with an axial opening;

a piston shaft having a first end passing through said axial opening of said piston and into said spherical socket, wherein movement of said shaft first end is restrained by a keeper, and having an opposed second end passing into a spring chamber in said body and terminating in a coupler;

a compression spring surrounding said piston shaft in said spring chamber; and means to supply fluid pressure to said cylindrical chamber to move said piston in a first direction and to move said piston in a second direction.

13. A fluid powered actuator as set forth in claim 12 including a seal mechanism between said piston and said piston shaft.

14. A fluid powered actuator as set forth in claim 12 including means to accommodate axial movement of said piston shaft with respect to said piston.

* * * * *